US008985737B2

(12) United States Patent
Momose

(10) Patent No.: US 8,985,737 B2
(45) Date of Patent: Mar. 24, 2015

(54) RECORDING APPARATUS AND RECORDING METHOD

(71) Applicant: Seiko Epson Corporation, Tokyo (JP)

(72) Inventor: Seigo Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/198,965

(22) Filed: Mar. 6, 2014

(65) Prior Publication Data

US 2014/0253622 A1 Sep. 11, 2014

(30) Foreign Application Priority Data

Mar. 11, 2013 (JP) ..... 2013-048386

(51) Int. Cl.
*B41J 29/393* (2006.01)
*B41J 29/17* (2006.01)
*B41J 11/00* (2006.01)

(52) U.S. Cl.
CPC ..... *B41J 29/17* (2013.01); *B41J 11/007* (2013.01)
USPC ..... 347/22; 347/33

(58) Field of Classification Search
None
See application file for complete search history.

(56) References Cited

U.S. PATENT DOCUMENTS 5,526,028 A 6/1996 Rottman

FOREIGN PATENT DOCUMENTS

| | | | |
|---|---|---|---|
| EP | 2489638 | A1 | 8/2012 |
| JP | 11-192694 | A | 7/1999 |
| JP | 2005-074043 | A | 3/2005 |
| JP | 2008-055837 | A | 3/2008 |
| JP | 2010-234217 | A | 10/2010 |
| JP | 2011-069022 | A | 4/2011 |
| JP | 2011-200855 | A | 10/2011 |
| JP | 2012-116093 | A | 6/2012 |
| JP | 2012-116617 | A | 6/2012 |
| WO | 2012/073907 | A1 | 6/2012 |

OTHER PUBLICATIONS

The extended European Search Report for European Application No. 14158674.3 mailed Jun. 25, 2014.

*Primary Examiner* — Lamson Nguyen
(74) *Attorney, Agent, or Firm* — Global IP Counselors, LLP

(57) ABSTRACT

There is provided an adhesive belt which is configured to support and transport a recording medium, a recording head which is configured to record by discharging ink onto the recording medium which is supported by the adhesive belt, and a cleaning mechanism which is configured to clean the adhesive belt. The cleaning mechanism has a cleaning liquid tank which is configured to have a cleaning liquid, a contact section which is configured to come into contact with the adhesive belt to apply the cleaning liquid and clean off ink which is attached to the adhesive belt, and an anti-foaming agent supply section which is configured to supply an anti-foaming agent for ink to the adhesive belt directly or via another member, and the anti-foaming agent remains on the adhesive belt.

9 Claims, 6 Drawing Sheets

RECORDING APPARATUS AND RECORDING METHOD

CROSS-REFERENCE TO RELATED APPLICATIONS

This application claims priority to Japanese Patent Application No. 2013-048386 filed on Mar. 11, 2013. The entire disclosure of Japanese Patent Application No. 2013-048386 is hereby incorporated herein by reference.

BACKGROUND

1. Technical Field

The present invention relates to a recording apparatus and a recording method where a transport mechanism, which transports a recording medium using an adhesive belt, is provided.

2. Related Art

In the prior art, recording apparatuses, which are provided with a transport mechanism which transports a recording medium by placing the recording medium on a moving belt, are used. Among such recording apparatuses, there are disclosed recording apparatuses which are provided with an adhesive belt, as the moving belt, where an adhesive, which holds the recording medium by bonding such that the recording medium is able to be peeled off, is attached to a surface where the recording medium is placed. In a case where images are recorded on the recording medium using the recording apparatus, there are cases where ink is attached to the adhesive belt which sticks out from an end section when recording is performed on the end section of the recording medium. In addition, in a case where fabric is used as the recording medium, there are cases where ink is attached to the adhesive belt due to ink bleeding out from the surface (an image forming surface) of the fabric to the rear surface.

As a result, for example, Japanese Laid-Open Patent Application Publication No. H11-192694 discloses a recording apparatus which is provided with an adhesive belt which performs transporting of the recording medium and a cleaning mechanism which is equipped with a wiping roller where the surface around the adhesive belt is formed of a porous polymer material.

However, in the recording apparatuses of the prior art which are provided with the adhesive belt which is able to support and transport the recording medium such as the recording apparatus which is disclosed in Japanese Laid-Open Patent Application Publication No. H11-192694, there are cases where bubbles which originate from ink are generated and the recording apparatus is soiled when the adhesive belt is cleaned. Here, the generation of bubbles which originate from ink is particularly remarkable in a contact section (for example, the position of the wiping roller in Japanese Laid-Open Patent Application Publication No. H11-192694) where the cleaning mechanism of the adhesive belt comes into contact with the adhesive belt.

SUMMARY

Therefore, an object of the present invention is to suppress the generation of bubbles which originate from ink when cleaning an adhesive belt which is able to support and transport a recording medium.

In order to solve the problems described above, a recording apparatus of a first aspect of the present invention includes an adhesive belt which is configured to support and transport a recording medium, a recording head which is configured to record by discharging ink onto the recording medium which is supported by the adhesive belt, and a cleaning mechanism which is configured to clean the adhesive belt. The cleaning mechanism has a cleaning liquid tank which is configured to have a cleaning liquid, a contact section which is configured to come into contact with the adhesive belt to apply the cleaning liquid and clean off ink which is attached to the adhesive belt, and an anti-foaming agent supply section which is configured to supply an anti-foaming agent for ink to the adhesive belt directly or via another member, and the anti-foaming agent remains on the adhesive belt.

According to the present aspect, it is possible to suppress the generation of bubbles which originate from ink since the anti-foaming agent for ink is supplied to the adhesive belt by the anti-foaming agent supply section. Moreover, the effect of suppressing the generation of bubbles which originate from ink is further increased due to continued use since the anti-foaming agent remains on the adhesive belt.

A recording apparatus of a second aspect of the invention is the recording apparatus of the first aspect, which is configured to record in a plurality of recording modes, and the recording apparatus further includes a control section which is configured to control at least one of a supply amount and a supply timing of the anti-foaming agent based on the recording mode.

According to the present aspect, it is possible to control at least one of the supply amount and the supply timing of the anti-foaming agent based on the recording mode. As a result, for example, since it is easy for bubbles which originate from ink to be generated in a recording mode where recording is performed up to end sections of the recording medium where it is easy for large amounts of ink to be attached to the adhesive belt, control which increases the supply amount of the anti-foaming agent and speeds up the supply timing is possible. That is, it is possible to effectively suppress the generation of bubbles which originate from ink.

A recording apparatus of a third aspect of the invention is the recording apparatus according to the first or second aspect which includes a sensor, which is configured to detect the degree of soiling of at least one of the adhesive belt and the cleaning liquid tank, and which includes a control section which is configured to control at least one of a supply amount and a supply timing of the anti-foaming agent based on the degree of soiling.

According to the present aspect, it is possible to control at least one of the supply amount and the supply timing of the anti-foaming agent based on the degree of soiling of at least one of the adhesive belt and the cleaning liquid tank. As a result, for example, since it is easy for bubbles which originate from ink to be generated in a case where the degree of soiling increases due to a large amount of ink being attached to the adhesive belt, it is possible to perform at least one of control which increases the supply amount of the anti-foaming agent and control which speeds up the supply timing. That is, it is possible to effectively suppress the generation of bubbles which originate from ink.

A recording apparatus of a fourth aspect of the invention is the recording apparatus according to any one of the first to third aspects, where the contact section is a rotating brush where at least one of a rotation speed and pressure on the adhesive belt is variable, and the recording apparatus further includes a control section which is configured to control at least one of a supply amount and a supply timing of the anti-foaming agent based on at least one of the rotation speed and the pressure which are variable.

Since the contact section is a rotating brush, it is easy for bubbles which originate from ink to be generated according to the rotation speed of the contact section and the pressure on the adhesive belt although cleaning power applied to the adhesive belt is high. However, according to the present aspect, it is possible to effectively suppress the generation of bubbles which originate from ink since at least one of the supply amount and the supply timing of the anti-foaming agent is controlled based on at least one of the rotation speed and pressure which are variable.

A recording apparatus of a fifth aspect of the invention is the recording apparatus according to any one of the first to fourth aspects, where the anti-foaming agent supply section supplies the anti-foaming agent to at least one of the cleaning liquid tank and the contact section.

According to the present aspect, the anti-foaming agent supply section supplies the anti-foaming agent to at least one of the cleaning liquid tank and the contact section. Since the generation of bubbles which originate from ink is particularly remarkable at the contact section, it is possible to effectively attach the anti-foaming agent to the contact section and it is possible to effectively suppress the generation of bubbles which originate from ink by supplying the anti-foaming agent to at least one of the cleaning liquid tank and the contact section.

A recording apparatus of a sixth aspect of the invention is the recording apparatus according to any one of the first to fifth aspects, which further includes a wiper for the adhesive belt provided between the adhesive belt and the cleaning liquid tank on a downstream side with regard to a supply position of the anti-foaming agent in a moving direction of the adhesive belt.

According to the present aspect, the wiper is provided on the downstream side with regard to the supply position of the anti-foaming agent in the moving direction of the adhesive belt. As a result, it is possible to recover bubbles which originate from ink at the contact section. In addition, the wiper is provided between the adhesive belt and the cleaning liquid tank. As a result, it is possible to reuse the anti-foaming agent by recovering a portion of the anti-foaming agent which is supplied to the adhesive belt.

A recording apparatus of a seventh aspect of the invention is the recording apparatus according to any one of the first to sixth aspects, where the anti-foaming agent supply section supplies the anti-foaming agent toward the wiper.

According to the present embodiment, since the anti-foaming agent supply section supplies the anti-foaming agent toward the wiper, it is possible for the wiper to eliminate bubbles when recovering bubbles which originate from ink which are generated at the contact section, and it is possible to suppress soiling of the recording apparatus due to bubbles overflowing from the cleaning liquid tank.

A recording apparatus of an eighth aspect of the present is the recording apparatus according to any one of the first to seventh aspects, where the anti-foaming agent supply section supplies the anti-foaming agent to the adhesive belt on an upstream side with regard to the contact section in a moving direction of the adhesive belt.

According to the present aspect, the anti-foaming agent supply section supplies the anti-foaming agent to the adhesive belt on the upstream side with regard to the contact section in the moving direction of the adhesive belt. Since the generation of bubbles which originate from ink is particularly remarkable at the contact section, it is possible to effectively suppress the generation of bubbles which originate from ink by supplying the anti-foaming agent to the adhesive belt on the upstream side with regard to the contact section in the moving direction of the adhesive belt.

A recording method of a ninth aspect of the invention is performed using a recording apparatus which is configured to record in a plurality of recording modes and which includes an adhesive belt which is configured to support and transport a recording medium, a recording head which is configured to record by discharging ink onto the recording medium which is supported by the adhesive belt, and a cleaning mechanism which is configured to clean the adhesive belt. The cleaning mechanism has a cleaning liquid tank which is configured to have a cleaning liquid, a contact section which is configured to come into contact with the adhesive belt to apply the cleaning liquid and clean off ink which is attached to the adhesive belt, and an anti-foaming agent supply section which is configured to supply an anti-foaming agent for ink to the adhesive belt directly or via another member, and the anti-foaming agent remains on the adhesive belt. The recording method includes controlling at least one of a supply amount and a supply timing of the anti-foaming agent based on the recording mode.

According to the present aspect, it is possible to control at least one of the supply amount and the supply timing of the anti-foaming agent based on the recording mode. As a result, it is possible to effectively suppress the generation of bubbles which originate from ink.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

FIG. 1 and FIG. 2

Below, a recording apparatus according to an embodiment of the present invention will be described in detail with reference to the accompanying drawings.

Figure 1:
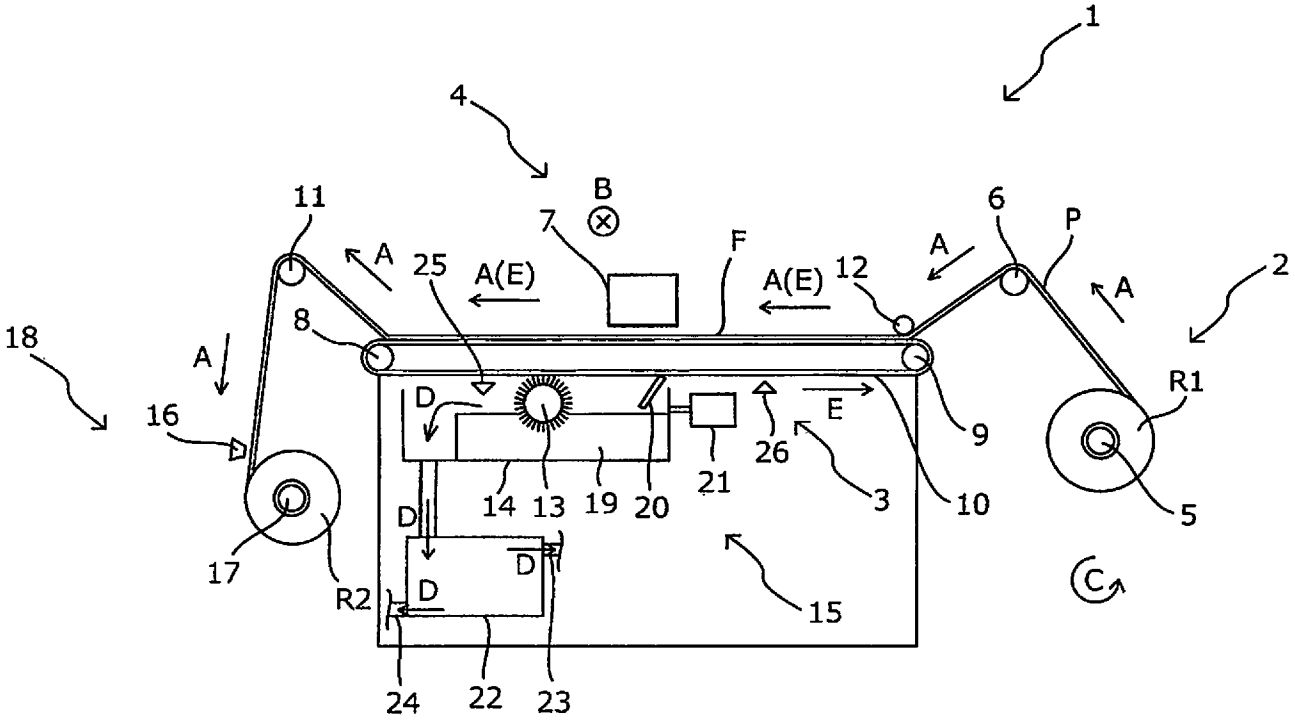
FIG. 1 is a schematic side surface diagram representing a recording apparatus of a first embodiment of the present invention.

FIG. 1 is a schematic side surface diagram of a recording apparatus 1 according to a first embodiment of the present invention.

The recording apparatus 1 of the present embodiment is provided with a feeding section 2 which is able to feed out a roll R1 of a recording medium P in order to perform recording. In addition, a transport mechanism 3 is provided which transports the recording medium P in a transport direction A using an adhesive belt 10 which supports the recording medium P on a support surface F where an adhesive is attached. In addition, a recording mechanism 4 is provided which records by a recording head 7 scanning back and forth in an intersecting direction B which intersects with the transport direction A of the recording medium P. In addition, a cleaning mechanism 15 of the adhesive belt 10 is provided. Furthermore, a winding mechanism 18 is provided which has a winding shaft 17 which winds the recording medium P and a cutter 16 which cuts the recording medium P which is wound. Here, the "adhesive belt" has the meaning of a belt where an adhesive, which holds the recording medium by bonding such that the recording medium is able to be peeled off, is attached to a surface where the recording medium is supported.

The feeding section 2 has a configuration where a rotating shaft 5 is provided to also be used for setting positions of the roll R1 of the recording medium P in order to perform recording, and where it is possible to feed out the recording medium P from the roll R1 which is set on the rotating shaft 5 to the transport mechanism 3 via a driven roller 6. Here, when the recording medium P is fed out to the transport mechanism 3, the rotating shaft 5 rotates in a rotation direction C.

The transport mechanism 3 is provided with the adhesive belt 10 where the recording medium P which is fed out from the feeding section 2 is placed and transported, and a transport roller 8 and a driven roller 9 which move the adhesive belt 10. The recording medium P is placed by being pressed and attached to the support surface F of the adhesive belt 10 using a pressing roller 12. Here, when the recording medium P is transported, the transport roller 8 rotates in the rotation direction C and the adhesive belt 10 moves in a moving direction E.

The recording mechanism 4 has the recording head 7 which is able to record by discharging ink onto the recording medium P which is supported by the adhesive belt 10, a carriage (which is not shown in the diagram) where the recording head 7 is mounted, and a carriage motor 35 (refer to FIG. 2) which moves the carriage back and forth in the intersecting direction B. Here, the intersecting direction B is a direction which is orthogonal with regard to the paper surface in FIG. 1.

During recording, the recording head 7 records by scanning back and forth, but the transport mechanism 3 stops transporting of the recording medium P during the recording and scanning (during movement of the recording head). In other words, back and forth scanning of the recording head 7 and transporting of the recording medium P are alternately performed during recording. That is, the transport mechanism 3 intermittently transports the recording medium P to correspond to back and forth scanning of the recording head 7 during recording.

The recording apparatus 1 of the present embodiment is provided with the recording mechanism 4 which records by the recording head 7 scanning back and forth, but the recording apparatus 1 is not limited to a recording mechanism with this configuration and the recording apparatus 1 may be provided with a recording mechanism which has a so-called line head which is provided with a nozzle row which discharges ink in a direction which intersects with the transport direction A.

The cleaning mechanism 15 of the adhesive belt 10 is provided with a cleaning liquid tank 14 which has a cleaning liquid 19 and a rotating brush 13 as a contact section which cleans off ink which is attached to the adhesive belt 10 by coming into contact with the adhesive belt 10 to apply the cleaning liquid 19. In addition, the cleaning mechanism 15 has an anti-foaming agent supply section 21 which supplies an anti-foaming agent for ink to the adhesive belt 10 via the cleaning liquid tank 14 and the rotating brush 13.

Here, the anti-foaming agent supply section 21 may be configured to supply the anti-foaming agent for ink directly to the adhesive belt 10.

In addition, the cleaning mechanism 15 is provided with a wiper 20 for the adhesive belt 10 between the adhesive belt 10 and the cleaning liquid tank 14 on the downstream side with regard to the rotating brush 13, which is the supply position of the anti-foaming agent to the adhesive belt 10, in the moving direction E of the adhesive belt 10. It is possible for the wiper 20 to recover bubbles which originate from ink which are generated at the contact section of the rotating brush 13 and the adhesive belt 10. In addition, it is possible to reuse the anti-foaming agent by recovering a portion of the anti-foaming agent which is supplied to the adhesive belt 10.

In addition, in the recording apparatus 1 of the present embodiment, the wiper 20 recovers only a portion of the anti-foaming agent which is supplied to the adhesive belt 10 and the anti-foaming agent remains on the adhesive belt 10. As a result, the effect of suppressing the generation of bubbles which originate from ink due to continued use of the recording apparatus 1 of the present embodiment is further increased. Here, "the anti-foaming agent remains on the adhesive belt" has the meaning that a removal section or the like which removes all of the anti-foaming agent which is supplied to the adhesive belt by the anti-foaming agent supply section is not provided. That is, for example, "the anti-foaming agent remains on the adhesive belt" has the meaning that a cleaning mechanism or the like formed of a rotating brush or the like which removes all of the anti-foaming agent is not provided at a rear stage of the cleaning mechanism. Accordingly, "the anti-foaming agent remains on the adhesive belt" has the meaning that a removal section, such as a wiper, which removes a portion of the anti-foaming agent which is supplied to the adhesive belt may be provided.

In addition, the rotating brush 13 of the present embodiment is a rotating brush where the rotation speed and the pressure on the adhesive belt 10 are variable. A rotating brush where at least one of the rotation speed and the pressure on the adhesive belt 10 is variable is preferable as in the rotating brush 13 in order to increase the capacity to clean the adhesive belt 10, but the rotating brush is not limited to such a rotating brush.

In addition, water is used as the cleaning liquid in the cleaning mechanism 15 of the present embodiment and water is supplied to the cleaning liquid tank 14 by a supply mechanism which is not shown in the diagram. Waste liquid from the cleaning liquid tank 14 is temporarily stored in a waste liquid tank 22 by being moved in a moving direction D, an organic solvent which includes the anti-foaming agent is supplied from a waste liquid tube 23 which is at an upper section to a water liquid tank which is not shown in the diagram, and water discharge where the main component is water is supplied from a waste liquid tube 24 which is at a lower section to a waste liquid tank which is not shown in the diagram.

In addition, the recording apparatus 1 of the present embodiment is provided with a sensor 26 which is able to detect the degree of soiling of the adhesive belt 10, and a sensor 25 which is able to detect the degree of soiling of the cleaning liquid tank 14.

The winding mechanism 18 is a mechanism which winds the recording medium P which is transported from the transport mechanism 3 via the driven roller 11 as recording is carried out, and it is possible to wind the recording medium P as a roll R2 by setting a paper tube or the like for winding on the winding shaft 17 and wrapping the recording medium P around the paper tube or the like.

Next, an electrical configuration of the recording apparatus 1 of the present embodiment will be described.

Figure 2:
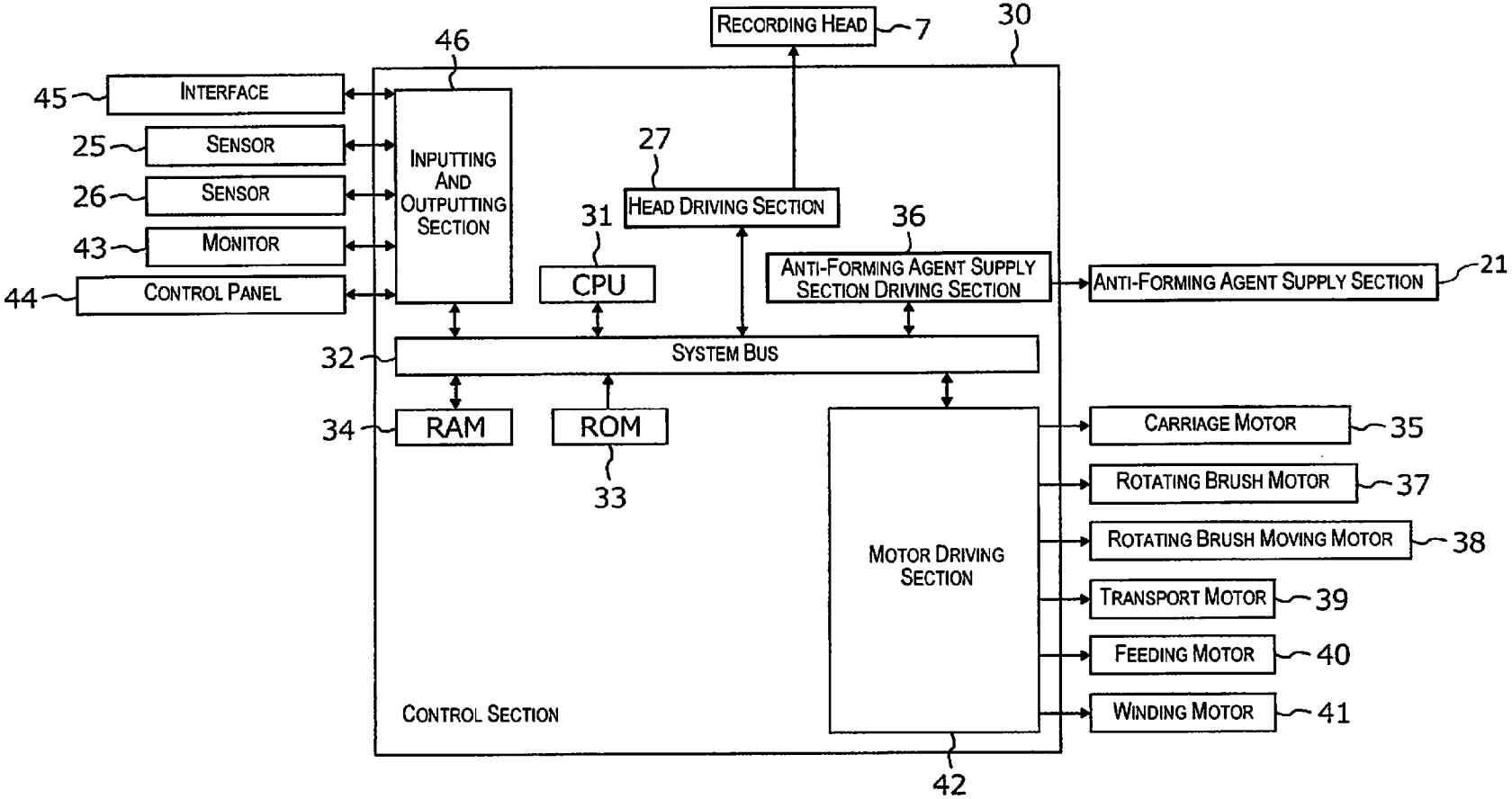
FIG. 2 is a block diagram of the recording apparatus of the first embodiment of the present invention.

FIG. 2 is a block diagram of the recording apparatus 1 of the present embodiment.

A CPU 31 which is in charge of controlling the entirety of the recording apparatus 1 is provided in a control section 30. In the CPU 31, a ROM 33 which stores each type of control program or the like which are executed by the CPU 31 and a RAM 34 which is able to temporarily store data are connected via a system bus 32. In addition, the CPU 31 is connected with a head driving section 27 for driving the recording head 7 via the system bus 32.

In addition, the CPU 31 is connected with an anti-foaming agent supply section driving section 36 for driving the anti-foaming agent supply section 21 via the system bus 32.

In addition, the CPU 31 is connected via the system bus 32 with a motor driving section 42 for driving the carriage motor 35, a rotating brush motor 37, a rotating brush moving motor 38, a transport motor 39, a feeding motor 40, and a winding motor 41.

Here, the carriage motor 35 is a motor for moving the carriage where the recording head 7 is mounted. In addition, the rotating brush motor 37 is a motor for rotationally driving the rotating brush 13. In addition, the rotating brush moving motor 38 is a motor for moving the rotating brush 13 in directions which approach and move away from the adhesive belt 10 in order to change the pressing force of the rotating brush 13 on the adhesive belt 10. In addition, the transport motor 39 is a motor for driving the transport roller 8. In addition, the feeding motor 40 is a rotating mechanism for the rotating shaft 5 and is a motor which drives the rotating shaft for feeding out the recording medium P to the transport mechanism 3. Then, the winding motor 41 is a driving motor for rotating the winding shaft 17.

Furthermore, the CPU 31 is connected with a monitor 43 and a control panel 44 which are provided in the recording apparatus 1, the sensor 26 which is able to detect the degree of soiling of the adhesive belt 10, the sensor 25 which is able to detect the degree of soiling of the cleaning liquid tank 14, an interface 45 for inputting or the like of recording data or the like from an external apparatus such as a PC, and an inputting and outputting section 46 for performing transmission and reception of data and signals.

It is possible for the recording apparatus 1 of the present embodiment to record in a plurality of recording modes. For example, it is possible to record in a recording mode where recording is performed up to end sections of the recording medium P in the width direction of the recording medium P, or a recording mode which records by recording and scanning the same parts a plurality of times. Then, programs which correspond to the plurality of recording modes are stored in the ROM 33, and it is possible for the control section 30 to control at least one of a supply amount and a supply timing of the anti-foaming agent based on the recording mode.

In addition, in the recording apparatus 1 of the present embodiment, it is possible for the control section 30 to control at least one of the supply amount and the supply timing of the anti-foaming agent based on at least one of the degrees of soiling which are detected by the sensor 26 which is able to detect the degree of soiling of the adhesive belt 10 or the sensor 25 which is able to detect the degree of soiling of the cleaning liquid tank 14.

In addition, in the recording apparatus 1 of the present embodiment, it is possible for the control section 30 to control at least one of the rotation speed of the rotating brush 13 or the pressure on the adhesive belt 10 based on at least one of the degrees of soiling which are detected by the sensors 25 and 26. On the other hand, it is also possible to control at least one of the rotation speed of the rotating brush 13 and the pressure on the adhesive belt 10 regardless of the degrees of soiling which are detected by the sensors 25 and 26. Then, it is possible to control at least one of the supply amount and the supply timing of the anti-foaming agent based on at least one of the rotation speed of the rotating brush 13 and the pressure on the adhesive belt 10.

The anti-foaming agent supply section 21 is configured to supply the anti-foaming agent to the cleaning liquid tank 14 in the recording apparatus 1 of the present embodiment and may be any configuration as long as the anti-foaming agent for ink is supplied to the adhesive belt 10 directly or via another member.

Below, embodiments will be described where an anti-foaming agent supply position according to the anti-foaming agent supply section 21 is different.

Second Embodiment

FIG. 3

Next, a recording apparatus according to a second embodiment of the present invention will be described.

Figure 3:
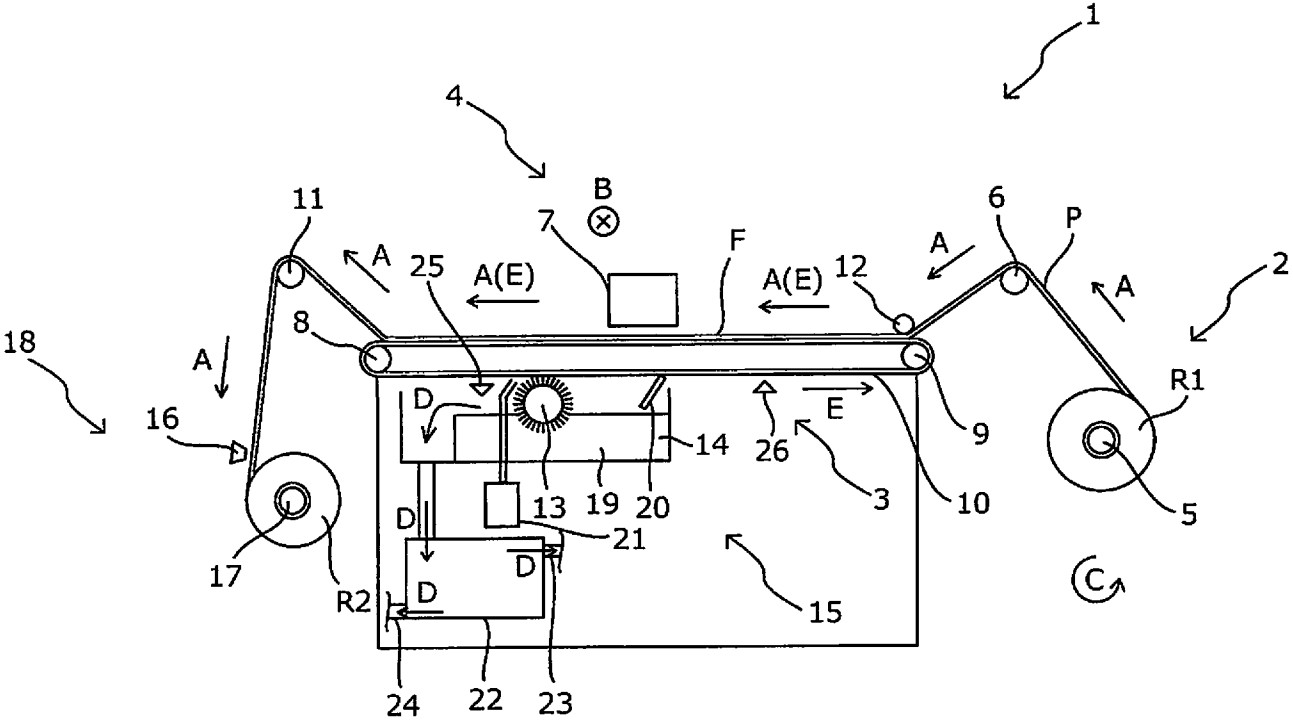
FIG. 3 is a schematic side surface diagram representing a recording apparatus of a second embodiment of the present invention.

FIG. 3 is a schematic side surface diagram of the recording apparatus 1 according to the second embodiment of the present invention. Here, the constituent members which are common to the embodiment described above are illustrated with the same reference numerals and detailed description of these constituent members will be omitted.

Only the anti-foaming agent supply position according to the anti-foaming agent supply section 21 in the recording apparatus 1 of the present embodiment is different to the recording apparatus 1 of the first embodiment.

In detail, the recording apparatus 1 of the present embodiment has a configuration where the anti-foaming agent is supplied to the rotating brush 13. According to this configuration, it is possible to effectively supply the anti-foaming agent at the contact section of the rotating brush 13 and the adhesive belt 10 where it is easiest for bubbles to be generated.

Third Embodiment

FIG. 4

Next, a recording apparatus according to a third embodiment of the present invention will be described.

Figure 4:
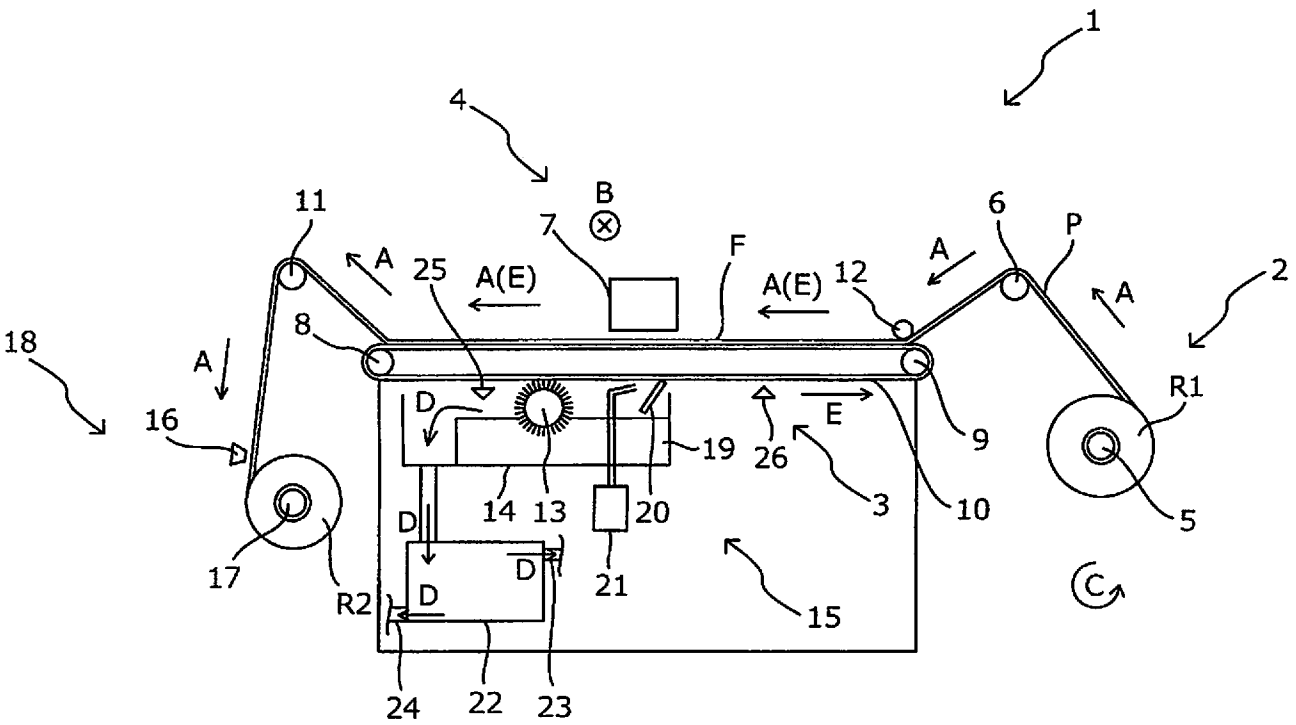
FIG. 4 is a schematic side surface diagram representing a recording apparatus of a third embodiment of the present invention.

FIG. 4 is a schematic side surface diagram of the recording apparatus 1 according to the third embodiment of the present invention. Here, the constituent members which are common to the embodiments described above are illustrated with the same reference numerals and detailed description of these constituent members will be omitted.

Only the anti-foaming agent supply position according to the anti-foaming agent supply section 21 in the recording apparatus 1 of the present embodiment is different to the recording apparatuses 1 of the first embodiment and the second embodiment.

In detail, the recording apparatus 1 of the present embodiment is configured to supply anti-foaming agent toward the wiper 20. According to this configuration, it is possible for the wiper 20 to eliminate bubbles when recovering bubbles which originate from ink which are generated at the contact section of the rotating brush 13 and the adhesive belt 10, and it is possible to suppress the soiling of the recording apparatus 1 due to bubbles overflowing from the cleaning liquid tank 14.

Fourth Embodiment

FIG. 5

Next, the recording apparatus according to a fourth embodiment of the present invention will be described.

Figure 5:
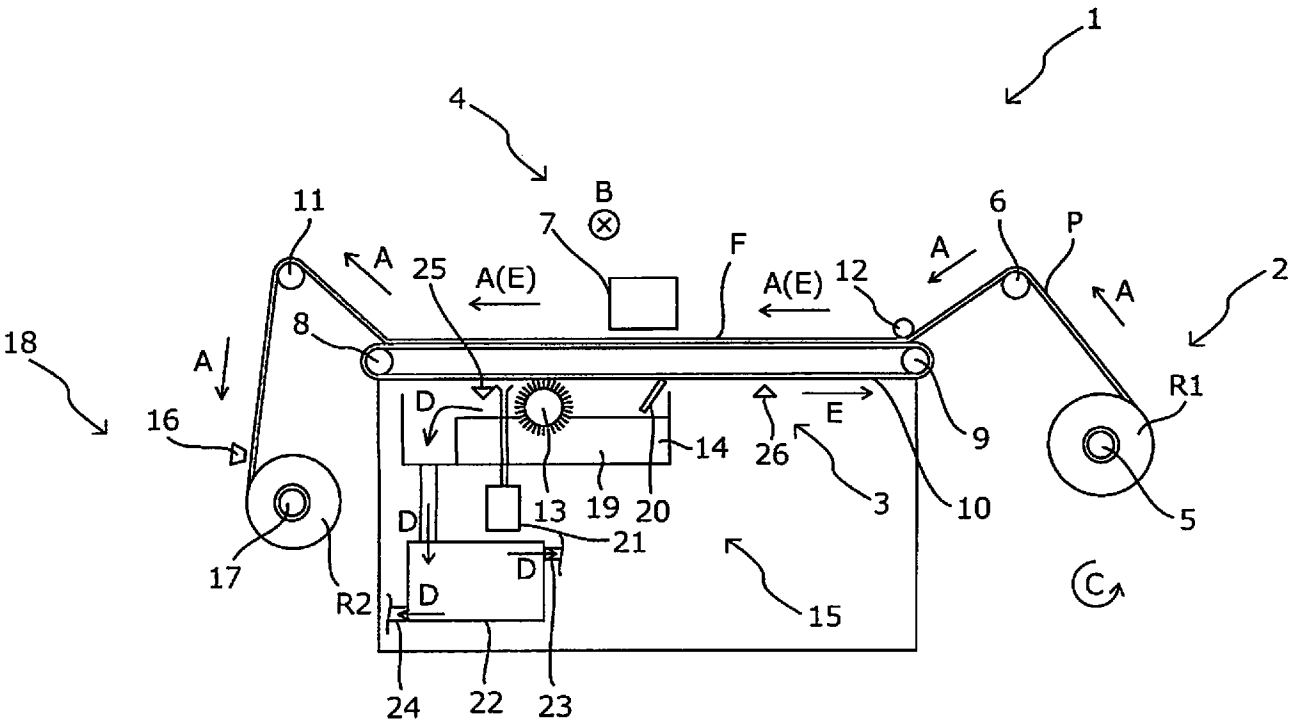
FIG. 5 is a schematic side surface diagram representing a recording apparatus of a fourth embodiment of the present invention.

FIG. 5 is a schematic side surface diagram of the recording apparatus 1 according to the fourth embodiment of the present invention. Here, the constituent members which are common to the embodiments described above are illustrated with the same reference numerals and detailed description of these constituent members will be omitted.

Only the anti-foaming agent supply position according to the anti-foaming agent supply section 21 in the recording apparatus 1 of the present embodiment is different to the recording apparatuses 1 of the first embodiment to the third embodiment.

In detail, the recording apparatus 1 of the present embodiment is configured to directly supply the anti-foaming agent to the adhesive belt 10 on the upstream side with regard to the rotating brush 13 in the moving direction E of the adhesive belt 10. Due to this configuration, it is possible to supply the anti-foaming agent to the adhesive belt 10 prior to the rotating brush 13 and the adhesive belt 10 coming into contact, and it is possible to effectively suppress the generation of bubbles.

In addition, as other configurations, there may be configurations where the rotating brush 13 is also used as at least a portion of the anti-foaming agent supply section as a configuration where it is possible to supply the anti-foaming agent from the rotating shaft side of the rotating brush 13 in a direction to the outside.

Embodiment of Recording Method

FIG. 6

Next, a recording method of the present embodiment will be described.

Figure 6:
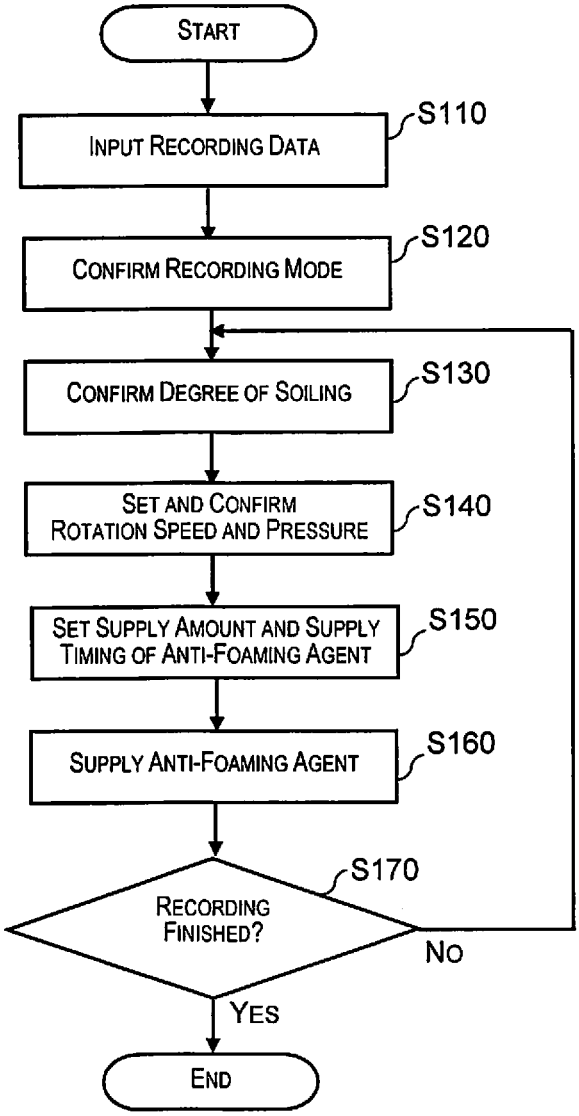
FIG. 6 is a flow chart representing an embodiment of a recording method of the present invention.

FIG. 6 is a flow chart representing the recording method of the present embodiment.

Here, the recording method of the present embodiment is an embodiment which is performed using the recording apparatus 1 of the first embodiment.

In the recording method of the present embodiment, firstly, when recording data is input into the recording apparatus 1 in step S110, the control section 30 confirms the recording mode from the recording data in step S120 and the recording apparatus 1 starts the recording operation.

Next, in step S130, the control section 30 confirms at least one of the degrees of soiling which are detected by the sensor 26 which is able to detect the degree of soiling of the adhesive belt 10 and the sensor 25 which is able to detect the degree of soiling of the cleaning liquid tank 14.

Next, in step S140, the control section 30 sets the rotation speed of the rotating brush 13 and the pressure on the adhesive belt 10 based on the degree of soiling which was confirmed in step S130, drives the rotating brush 13 under the conditions which have been set, and confirms the set values of the rotation speed of the rotating brush 13 and the pressure on the adhesive belt 10.

Next, in step S150, the control section 30 sets at least one of the supply amount and the supply timing of the anti-foaming agent based on the recording mode, the degree of soiling, the rotation speed of the rotating brush 13, and the pressure on the adhesive belt 10.

Next, in step S160, the anti-foaming agent supply section 21 supplies the anti-foaming agent under control by the control section 30 at the supply amount and the supply timing of the anti-foaming agent which were set in step S150.

Next, it is determined whether recording is finished in step S170, step S130 to step S170 are repeated until it is determined that the recording is finished, and in a case where it is determined that recording is finished, the recording method according to the present embodiment finishes.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

an adhesive belt configured to support and transport a recording medium;

a recording head configured to record by discharging ink onto the recording medium that is supported by the adhesive belt; and a cleaning mechanism configured to clean the adhesive belt, the cleaning mechanism including a cleaning liquid tank configured to have a cleaning liquid, a contact section configured to be immersed into the cleaning liquid in the cleaning tank and come into contact with the adhesive belt so as to apply the cleaning liquid, which adheres to the contact section, to the adhesive belt and clean off ink which is attached to the adhesive belt, and an anti-foaming agent supply section configured to supply an anti-foaming agent for ink to the adhesive belt directly or via another member, the anti-foaming agent remaining on the adhesive belt.

2. The recording apparatus according to claim 1, which is configured to record in a plurality of recording modes, further comprising a control section configured to control at least one of a supply amount and a supply timing of the anti-foaming agent based on the recording mode.

3. The recording apparatus according to claim 1, further comprising:

a sensor configured to detect a degree of soiling of at least one of the adhesive belt and the cleaning liquid tank; and a control section configured to control at least one of a supply amount and a supply timing of the anti-foaming agent based on the degree of soiling.

4. The recording apparatus according to claim 1, wherein the contact section is a rotating brush where at least one of a rotation speed and pressure on the adhesive belt is variable, and the recording apparatus further comprises a control section that is configured to control at least one of a supply amount and a supply timing of the anti-foaming agent based on at least one of the rotation speed and the pressure which are variable.

5. The recording apparatus according to claim 1, wherein the anti-foaming agent supply section supplies the anti-foaming agent to at least one of the cleaning liquid tank and the contact section.

6. The recording apparatus according to claim 1, further comprising a wiper for the adhesive belt, the wiper being disposed between the adhesive belt and the cleaning liquid tank on a downstream side with regard to a supply position of the anti-foaming agent in a moving direction of the adhesive belt.

7. The recording apparatus according to claim 6, wherein the anti-foaming agent supply section supplies the anti-foaming agent toward the wiper.

8. The recording apparatus according to Claim 1, wherein the anti-foaming agent supply section supplies the anti-foaming agent to the adhesive belt on an upstream side with regard to the contact section in a moving direction of the adhesive belt.

9. A recording method which is performed using a recording apparatus that is configured to record in a plurality of recording modes and includes an adhesive belt configured to support and transport a recording medium, a recording head configured to record by discharging ink onto the recording medium that is supported by the adhesive belt, and a cleaning mechanism configured to clean the adhesive belt, the cleaning mechanism having a cleaning liquid tank configured to have a cleaning liquid, a contact section configured to be immersed into the cleaning liquid in the cleaning tank and come into contact with the adhesive belt so as to apply the cleaning liquid, which adheres to the contact section, to the adhesive belt and clean off ink which is attached to the adhesive belt, and an anti-foaming agent supply section configured to supply an anti-foaming agent for ink to the adhesive belt directly or via another member, the anti-foaming agent remaining on the adhesive belt, the recording method comprising:

controlling at least one of a supply amount and a supply timing of the anti-foaming agent based on the recording mode.

* * * * *